US005634278A

United States Patent [19]

London

[11] Patent Number: 5,634,278

[45] Date of Patent: Jun. 3, 1997

[54] BOW SIGHT

[75] Inventor: William E. London, 6722 Hixson Pike, Hixson, Tenn. 37343

[73] Assignees: Tommy E. Hefner, Eight Mile, Ala.; William E. London, Chattanooga, Tenn.; a part interest

[21] Appl. No.: 530,873

[22] Filed: Sep. 20, 1995

[51] Int. Cl.[6] ..... F41G 1/467; F41G 1/32

[52] U.S. Cl. ..... 33/241; 33/265; 124/87

[58] Field of Search ..... 33/265, 241; 124/23.1, 124/24.1, 87

[56] References Cited

U.S. PATENT DOCUMENTS

| | | | |
|---|---|---|---|
| 4,325,190 | 4/1982 | Duerst | 33/241 |
| 4,400,887 | 8/1983 | Mason | 33/265 |
| 4,584,777 | 4/1986 | Saunders | 33/265 |
| 4,894,921 | 1/1990 | Barlow | 33/265 |
| 5,090,805 | 2/1992 | Stawarz | 356/251 |
| 5,152,068 | 10/1992 | Meister et al. | 124/87 |

*Primary Examiner*—Thomas B. Will
*Attorney, Agent, or Firm*—Alan Ruderman

[57] ABSTRACT

A bow sight includes a housing which is mounted on an archery bow and carries electronic circuitry including a series of aligned target LED's which may be programmed by an archer to correspond to different respective target distances. The housing mounts a color separating dichroic filter sight glass positioned at an angle between upper and lower housing walls. The LED's are positioned to overlay an elongated slot in the top wall so that a lighted LED reflects onto a surface of the glass and may be viewed for sighting a target. Two other LED's, one on each side of the target LED's, are included in the circuitry and may be programmed to light when the bow is tilted to a selected side-wise position, apertures in the top wall of the housing permitting reflection of each of these LED's onto the sight glass. After each target LED have been programmed, the archer may sight through the sight glass and align the reflection of the lighted target LED onto the target.

15 Claims, 4 Drawing Sheets

BOW SIGHT

BACKGROUND OF THE INVENTION

This invention relates to an archery bow sight and more particularly to an electronic bow sight having a plurality of light emitting elements which may be electronically programmed to correspond to respective target distances, two of which may be electronically programmed to indicate sidewise tilt of the bow.

The projectory of an arrow propelled from a bow is directly related to the distance that the arrow traverses. An archer, aiming at a target, must estimate the distance to the target, ensure that the bow is vertical, pull back on the bow string, sight the target and tilt the bow to an angle to the horizontal to provide the correct projectory and thus distance to the target. Range finding devices are available for detecting the distance to the target and a number of patents show use of sight pins to aid the archer to sight to the correct distance including Mason U.S. Pat. No. 4,400,887; Duerst U.S. Pat. No. 4,325,190; and Gould U.S. Pat. No. 4,953,302. Mason proposed a plurality of sight pins and a pendulum control responsive to the angle of the bow for controlling the transfer of light via fiber optic members from a number of light sources to the pins so as to distinguish one of the pins from the others; Duerst proposed a number of sight pins which are selectively illuminated according to the angle of inclination of the bow by means of a circuit including a plurality of mercury tilt switches; while Gould proposes a split screen range finder and pins lighted by LED's when the bow is positioned to provide the appropriate distance, and the archer aligns the point of aim with the lit pin or between two lit pins. Thus, each of these proposals are for lighted sight pins, but none of the prior art appears to permit the ready positioning of a distance to which the bow may fire an arrow.

SUMMARY OF THE INVENTION

Consequently, it is primary object of the present invention to provide an electronic bow sight which may be readily programmed to selected distances.

It is another object of the present invention to provide a bow sight which once mounted on the bow and mechanically adjusted for windage, i.e., side-to-side distance, it may be electronically programmed for various tilt angles corresponding to respective distances for firing an arrow to a target sighted at a distance, and may be programmed to provide indications that the bow is at a desired angle relative to the vertical plane between the target and the bow.

It is a further object of the present invention to provide an electronically programmable bow sight having a plurality of lights, certain of which may be programmed to light when the bow is inclined at an angle which will shoot an arrow to respective selected distances, and others of which may be programmed when the sight is mounted on a bow to either light when the bow is not vertically aligned either to the right or the left.

Accordingly, the present invention provides a bow sight including a housing readily mounted on a bow and carrying electronic apparatus including a tilt sensor for determining the tilt of the bow from front to back and from side-to-side, a plurality of light emitters in the form of LED's, a microcontroller having a CPU, a plurality of switches and a source of electrical power. One of the switches activates the system. A second of the switches has three modes, one being a light mode, a second being a program mode and the third being a run mode. The third switch is used to cause a selected one of the LED's to light when the second switch is in the light mode. When the second switch is moved to the program mode the selected LED stays lit and the third switch may be used to select one of a plurality of pre-selected ranges or angular tilts of the bow from memory in the microcontroller to correspond to that LED. When the second switch is moved to the run mode, the selected distance, range or angular tilt is stored in EEPROM memory in the microcontroller and thereafter corresponds to that LED until re-programmed. Thereafter, in the run mode when the bow is tilted to the angle corresponding to the stored range, as determined by the tilt sensor, the corresponding LED will light.

After all of the LED's have been programmed in this manner, placing the second switch in the run mode and tilting the bow to a given angle will result in lighting the LED corresponding to that tilt angle, and thus the distance corresponding thereto. When the target is sighted and an LED is lit the bow will be at the correct angle to fire an arrow to the distance at which the target is located. Two of the LED's may be used to pre-program the sight so that either LED will light when the bow is tilted to the right or the left of vertical by a desired amount. The other of the LED's are programmed to correspond to selected tilts relative to horizontal and thus distances from the bow.

The housing in which the electronic apparatus is carried supports a sight glass which preferably comprises a color separating dichroic filter glass through a target may be sighted, the glass being disposed at an angle to the light rays projected by the LED's. Thus, the LED's may be placed out of the view of the target and project light onto the glass to permit the archer to aim a lighted LED at the target. Only a small dot of reflected light on the glass is seen by the archer and is only visible on the archer's side of the glass.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
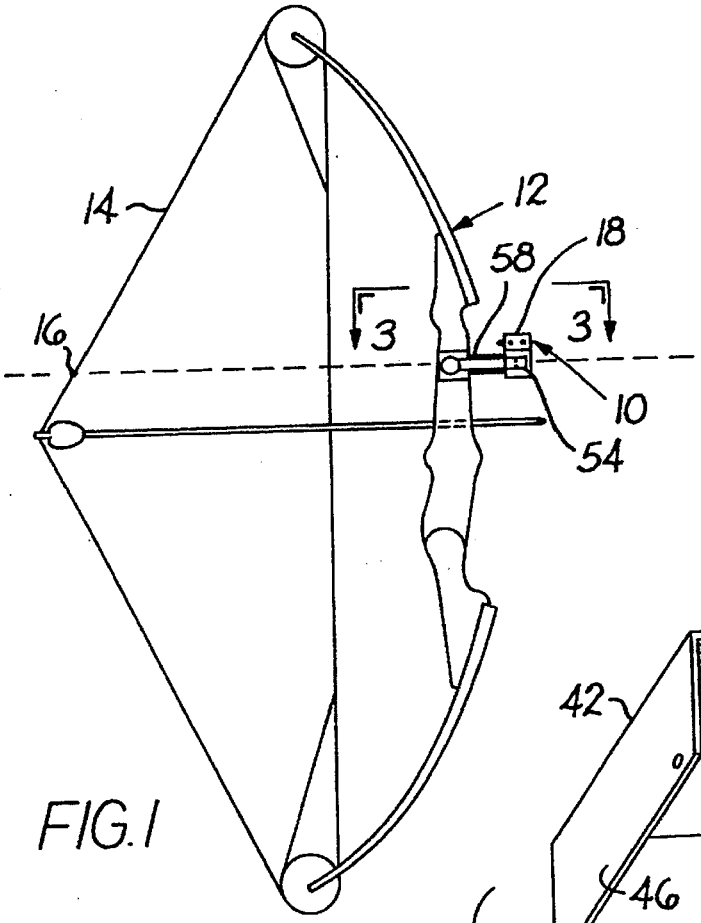
FIG. 1 is a side elevational view of a conventional bow having a bow sight constructed in accordance with the principles of the present invention mounted thereon.
Figure 2:
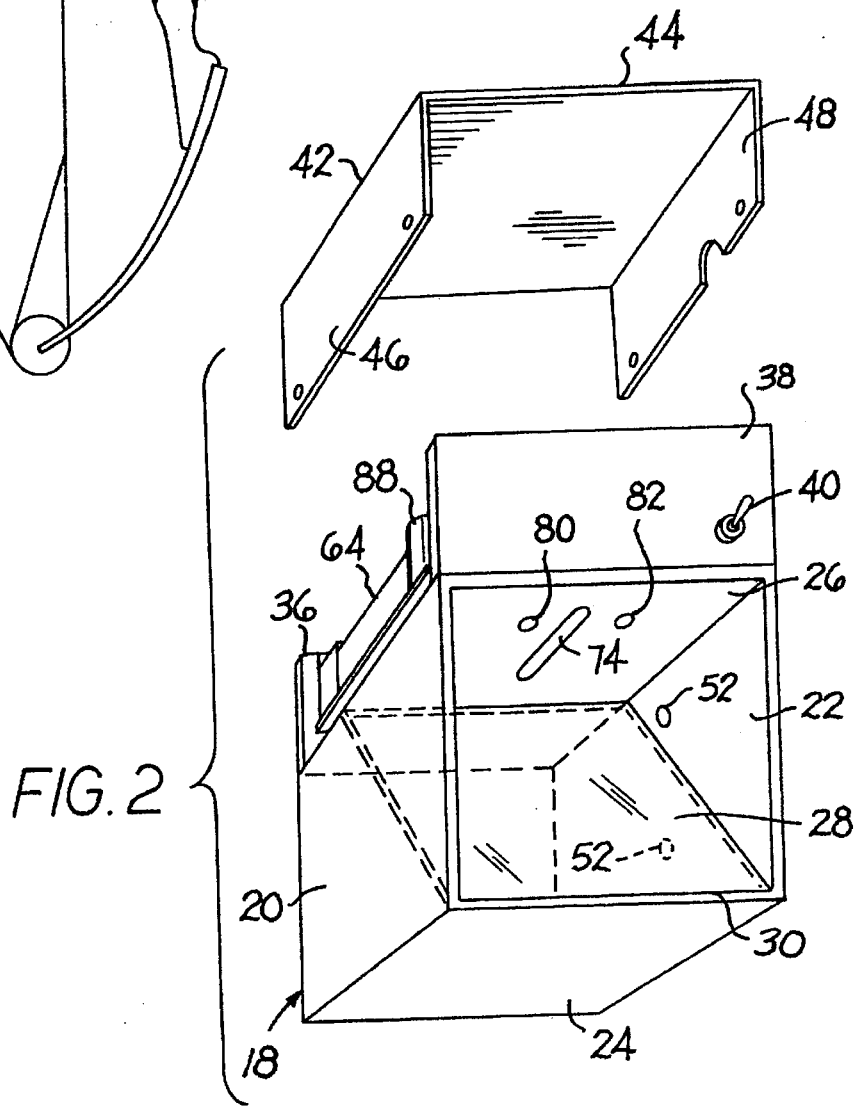
FIG. 2 is a rear perspective view of the bow sight removed from the bow and with the cover exploded therefrom.
Figure 3:
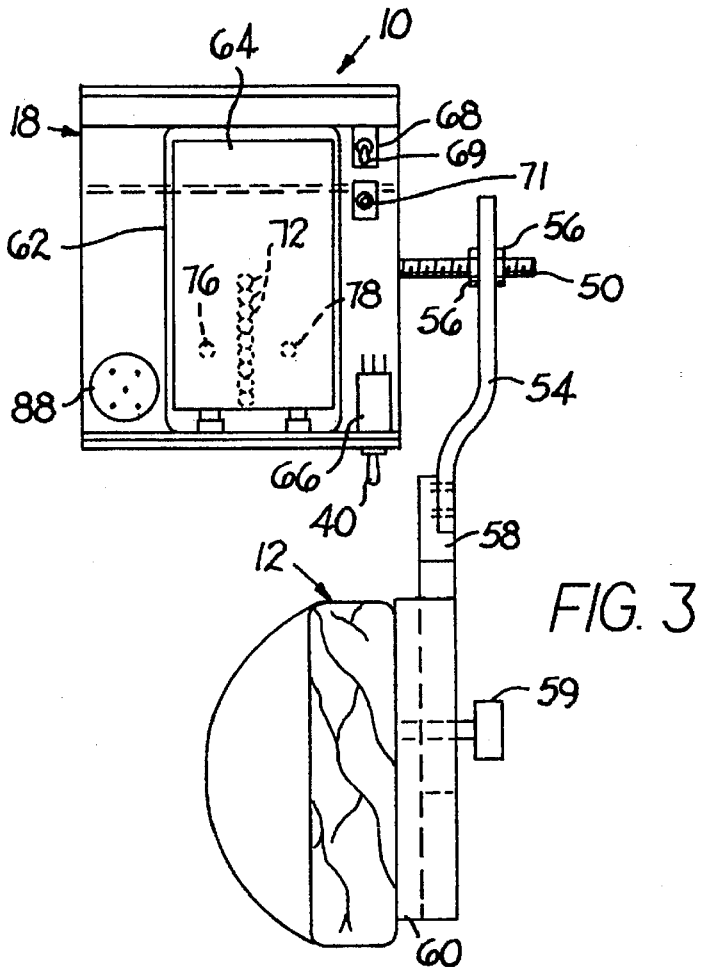
FIG. 3 is a view taken substantially along line 3—3 of FIG. 1 with the cover of the bow sight removed.
Figure 4:
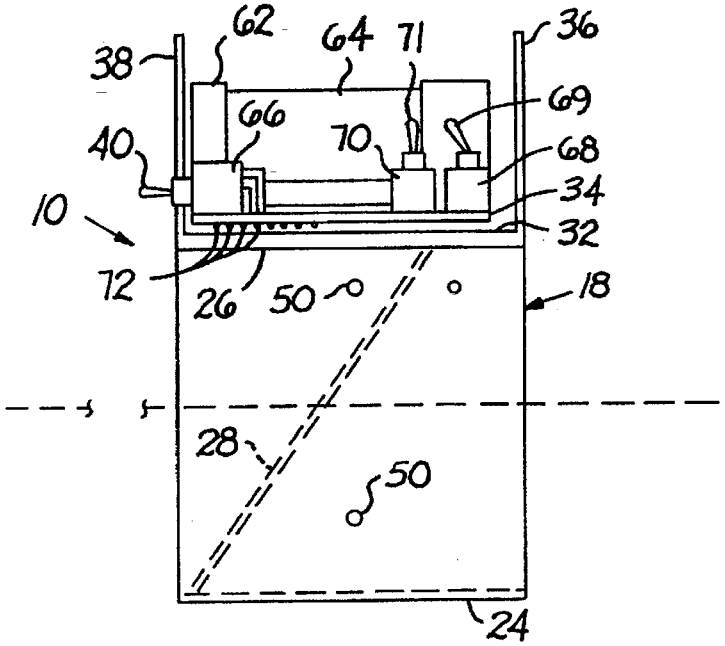
FIG. 4 is a side elevational view of the sight with the cover removed.

Referring to the drawings, a bow sight 10 constructed in accordance with the present invention is illustrated in FIG. 1 as mounted on a conventional bow 12. The bow string 14 may have a peep sight 16 mounted thereon for aligning a target (not illustrated) with an aiming point on the sight as hereinafter described. The bow sight 10 includes a housing 18 which, as best illustrated in FIG. 2, may be of a rectangular box-like configuration having a pair of opposed side walls 20, 22, a bottom wall or floor 24 and a top wall or ceiling 26. The front, which faces a target or field, and the rear, which faces the archer, of the housing are open and a sight glass 28 is disposed therein. The sight glass extends at an inclined angle from the rear edge 30 of the bottom of the housing to the top wall 26 spaced from the front, for reasons hereinafter made clear, the angle of inclination being in the order of approximately 40 to 45 degrees relative to the bottom wall.

Positioned on the upper surface 32 of the top wall 26 is the underside of a circuit board 34 which carries the electrical components of the bow sight. Preferably, the sight housing includes a front upstanding wall 36 above the open front and a rear upstanding wall 38 above the open rear, and a switch operator 40 preferably extends through the wall 38 for ready access by the archer. A cover 42 preferably overlays and encloses the electrical components of the sight, the cover having a top wall 44 and a pair of opposed side walls 46, 48 positioned between the upstanding walls 36, 38.

A pair of studs 50 may be fastened into apertures 52 in the side wall 22 of the sight housing and extend outwardly, each stud being secured to a mounting bracket 54 by a pair of jam nuts 56 or the like that may be adjustably positioned to select and correct for windage for the sight. The bracket 54 is secured by screw means to a connecting member 58 with a slotted arm adjustably positioned relative to stud 59 which is clamped to a conventional dovetail mounting piece 60 secured by screw means to the bow 12.

Supported by a battery holder 62 and connected to the circuit board 34 is a battery 64 which supplies the electrical power for the bow sight 10. The electrical circuit includes three switches connected to the circuit board 34, a first switch 66 controlled by the switch operator 40, a second switch 68 controlled by a switch operator 69 and a third switch 70 controlled by a switch operator 71. The switch 66 is a three position switch having an "off" position and two "on" positions for reasons hereinafter described. The switch 68 is a three position switch having a "light" position a "program" position and a "run" position. The switch 70 has one stable position and two astable positions which may be selected by moving the switch operator 71 from the stable center position to either side, and when the switch operator 71 is released, the switch is spring returned to the center position.

The electrical circuit further includes a series of aligned light emitting diodes (LED's) 72 disposed on the circuit board 34 is aligned so as to be positioned above an elongated slot 74 and the top wall 26 of the housing 18, and a pair of LED's 76, 78 respectively disposed on the circuit board 34 at opposite sides of the row of LED's 72 so as to be positioned above a respective aperture 80, 82 in the top wall 26 of the housing 18. The number of LED's 72 may be selectively determined by the number of discreet separate distances for which the sight is to be programmed, and to a large extent this will depend on the range capacity of the bow. For example, in the preferred mode as constructed in a prototype, there may be eight such LED's with each LED programmed for respective five yard distances such as 30 yards, 35 yards, 40 yards, etc. If desired, 24 such LED's may be utilized with the electrical components of the prototype system.

Figure 5:
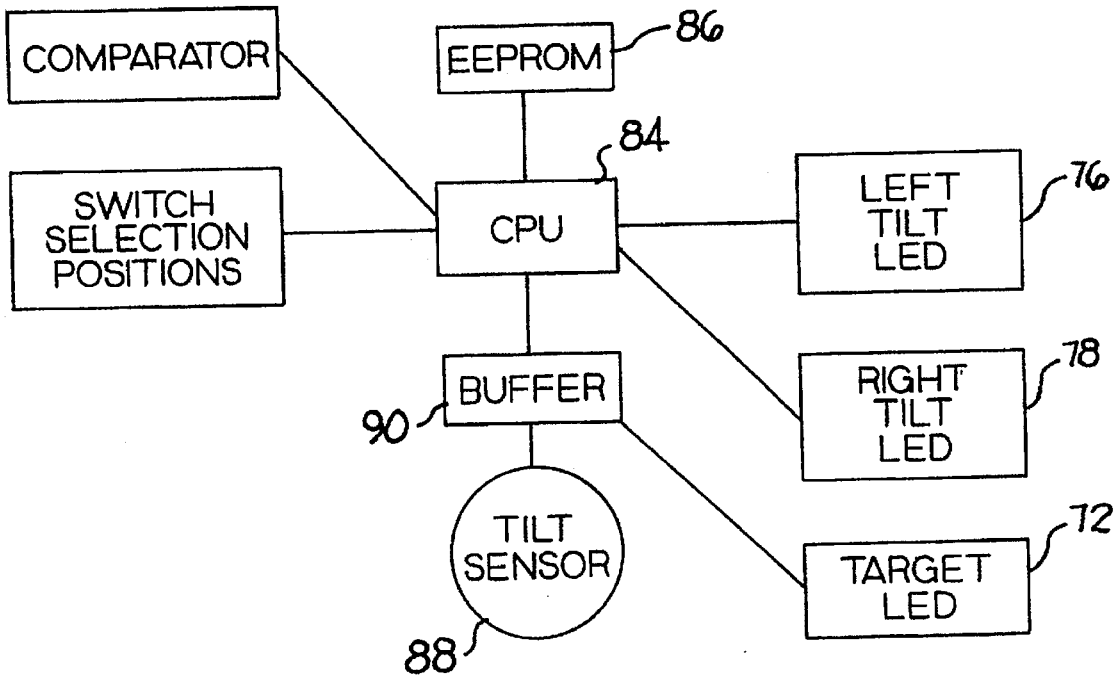
FIG. 5 is a block diagram of the control system of the bow sight.

Also mounted on the circuit board 34 and connected into the electrical circuit, as illustrated in FIG. 5, is a microcontroller 84, a read only programmable memory which is electrically erasable (EEPROM) 86, and a tilt sensor 88. The microcontroller 84 comprises a CPU which may be one of the Motorola MC68HC05 family of 8-bit microcontroller units such as an MC68HC705P6 manufactured by Motorola Corporation of Phoenix, Ariz., which includes random access memory (RAM) and read only memory, (ROM), and which communicates with the switches 66, 68, 70, the tilt sensor 88 and the EEPROM, is programmed to control the logical sequences of the LED's in response to the positions of the switches 66, 68, 70 and the signals received from the tilt sensor 88. The EEPROM 86 may be a unit such as a 24LC01 EEPROM 1K bit memory unit manufactured by Microchip Technology, Inc. of Chandler, Ariz., this memory unit being slaved to the microcontroller 84 to either read or write and response thereto. The tilt sensor 88 may be an electrolytic tilt sensor such as one of the SP5000 series of vertical sensing electrolytic potentiometers manufactured by Spectron Glass & Electronics of Hauppauge, N.Y. which is a two-axis unit that provides a substantially linear voltage output in response to being tilted about each horizontal axis. This tilt sensor 88 has an electrolyte fluid within a glass envelope or tube and is mounted on the upper surface of the circuit board 34 with the battery 64 and the switches 66, 68, 70. Since the preferred tilt sensor requires a.c. excitation, a resonator or oscillator (not illustrated) is utilized in the circuit to provide a square, triangular or sine wave shape signal to the tilt sensor. Additionally, the circuit includes an I/O buffer 90 such as an inverting tri-state buffer between the tilt sensor 88 and the microcontroller 84 to enable one signal at a time from the tilt sensor to be routed to the CPU. A buffer of this type is the model MM54HCT240 manufactured by National Semiconductor Corporation of Santa Clara, Calif.

The microcontroller 84 is programmed so that the two "on" positions of the first switch 66 may activate the target LED's 72 in two different modes. For example, the LED's are activated in a first mode, which may be when the bow is programmed at and for firing at ground level, i.e., a "ground" position, or are activated in a second mode such as when the bow is programmed at elevation such as in a tree stand for firing at that elevation, i.e., a "stand" position. Of course, all of the LED's may be programmed at ground level in either "on" position. Thus, each target LED may be programmed for two different distances depending upon the selected mode. This effectively doubles the number of discreet range settings for the target LED's.

The microcontroller 84 is also programmed so that when the second switch 68 is in the "light" position and the first switch 66 is in one of the "on" positions, a first of the LED's 72 will be energized and emit light. Preferably, as in the preferred embodiment, this is an LED at one end of the aligned series of target LED's. This occurs while the third switch 70 is in the stable center position. When the third switch 70 is then moved once, or one click to a selected one of the astable positions, the LED next adjacent the lighted LED will be energized and emit light and the first LED will cease to be lighted. In this manner with the switch 68 in the "light" position any of the target LED's may be selected to be lighted by sequentially activating the third switch 70. The archer may select to light any of the LED's merely by moving the third switch 70 from the stable center position to an astable position and releasing it to its stable position. Each time this occurs one subsequent adjacent LED will light and the prior lighted LED will cease to light. In this manner any of the LED's 72 may be selected to be programmed to correspond to a selected distance or range.

Figure 6:
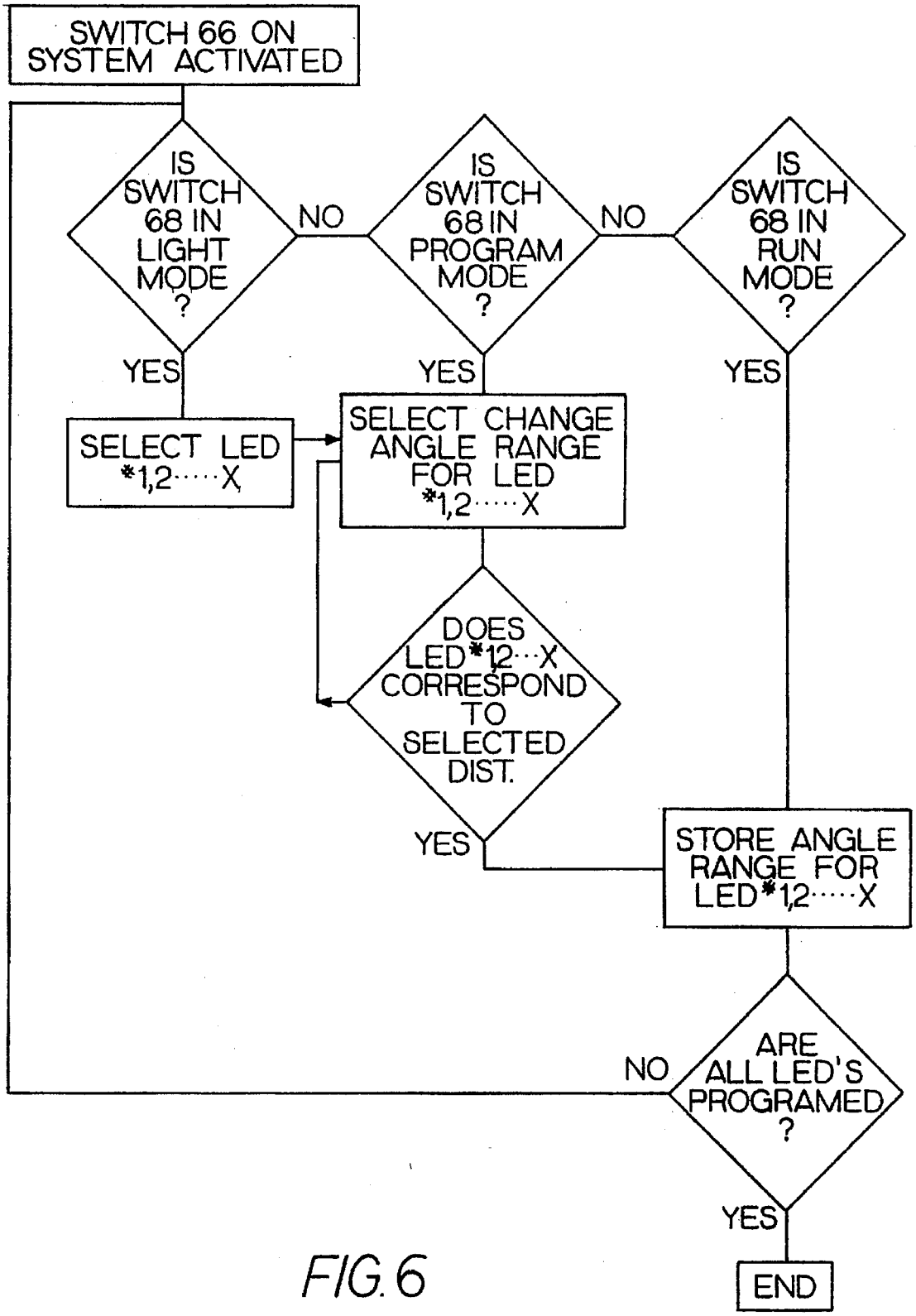
FIG. 6 is a flow chart diagram of the program in operation for programming the bow sight.

The microcontroller 84 is programmed so that when an LED has been selected as aforesaid and the second switch 68 is moved to the "program" position, a selected angular tilt of the bow may be programmed to correspond to that LED. For example, if the total angular range, corresponding to a distance range, through which the bow would travel from a minimum range to a maximum range, is broken down or divided into segments or windows, each of which has a small angular portion of the total angular range, any of the segments or windows can be made to correspond to the selected LED. This information as to the angular travels assigned to each window may be initially programmed into the ROM of the CPU or into the EEPROM 86. Thus, assuming an angular travel of the bow between, for example, 100° to 104° for a first window corresponding to, for example, 30 yards, a second angular travel of between 104° to 108° for a second window corresponding to 35 yards, and a third angular travel of the bow for a third window to be between 108° to 112° corresponding to 40 yards, with the switch 68 in the "program" position the third switch 70 may be used to move or inch the windows up or down in increments by intermittently moving the switch 70 from the stable position to one of the astable positions, and depending upon which astable position is activated the window will move in one direction or the other, i.e., either up or down. After an LED has been selected to be programmed for a selected distance, which of course corresponds to the angle the particular bow makes with the horizontal axis which is perpendicular to the vertical plane between the target and the archer, or the angle of the bow in that plane, the archer shoots an arrow to a target at the known selected distance, and if the arrow falls short or overshoots the desired distance, the switch 70 is activated to move another window, with a different angular range, to correspond to the selected target LED. This procedure is repeated until the selected target LED corresponds to the selected field distance. The operator 69 of the switch 68 is then moved to the "run" position which writes or burns the tilt angle or angular range and the LED corresponding thereto into the memory of the EEPROM 86. The "run" position thus provides a store or save command. This process is illustrated in flow chart form in FIG. 6.

After all the target LED's 72 have been programmed in this manner, when the bow is to be fired at a target, the first switch 66 is placed in either the "ground" or "stand" position depending upon the location of the archer, and the toggle operator 69 of the second switch 68 is placed in the "run" mode. As the bow is tilted the tilt sensor 88 reads the degree of movement of the bow and this information is compared with the information stored in the EEPROM resulting in the corresponding LED to be lighted. When the target is sighted through the peep sight 16, the LED corresponding to the target range or yardage lights. The bow then will be at the proper correct angle for shooting an arrow to that distance. If one of the LED's is set for a distance of 30 yards and the next LED is set for 25 yards, the first LED may be programmed to turn off and the second LED to turn on as the bow is lowered to an angle corresponding to a distance of approximately 27½ yards. When desired, any or all of the LED's may be reprogrammed at any time.

Indication of side-wise tilt, i.e., the angle of the bow relative to the horizontal axis which lies substantially in the vertical plane between the target and the archer, i.e., the angle of the bow to that vertical plane, may be determined by the two tilt LED's 76, 78. The microcontroller 84 may be programmed so that the left LED 76 will light when the bow is tilted to the left a preselected angle, and the right LED 78 will light when the bow is tilted to the right a preselected angle. The preselected angles maybe written into the ROM associated with the microcontroller 84. In that manner, the bow may be positioned between these two angles for archers that hold the bow in a substantially upright or vertical disposition. As long as neither of the LED's 76, 78 light, the bow will be within that narrow vertical range. However, since some archers may rather have the bow tilted relative to the vertical, it may be desirable to permit the archer to program the two side-wise tilt LED's so that they light when the bow is tilted to a desired angle to either side. To this end, the program in the microcontroller 84 is written such that with the first switch 66 in the "off" position, the second switch 68 is placed in the "program" position. The bow is then tilted to the desired angle either right or left and the first switch 66 is then moved to the "ground" position. This writes or burns the angle determined by the tilt sensor 88 into the EEPROM. When the second switch 68 is thereafter placed in the "run" position, the left tilt or the right tilt LED 76, 78 will light when the bow is positioned to the selected angle. Of course, since this angle is programmed into the EEPROM, reprogramming to another tilt angle may be made if and when desired.

After the target LED's and the tilt angle LED's have been programmed as above, the archer merely places the first switch 66 in the desired "on" position either "ground" or "stand" and places the second switch 68 into the "run" position. The tilt indicator 88 will turn on the correct target LED for the yardage of the sighted target and the desired side wise tilt angle LED or LED's 76, 78 will indicate that the bow is tilted to or between the desired angle relative to the plane between the target and the bow. The archer sights through the peep sight 16 through the sight glass 28 onto the target. The sight glass 28 is a conventional color separating dichroic filter glass which, when positioned at approximately 45°, permits all but one color of the light spectrum to pass through the glass, the one color being reflected onto one surface of the glass. Although this glass is available for reflecting most any one color and to permit the remainder of the light spectrum to pass directly through, in the preferred embodiment the glass reflects the color red since this is the preferred color of the LED's. If LED's of another color are utilized, then a dichroic filter glass will be chosen that reflects such other color and will pass red and the remaining color spectrum of the light through. Thus, the red reflection of the target LED and the side-wise tilt angle LED's may be seen clearly on the sight glass. When the reflection of the desired target LED, which can be seen as a red dot, is aligned with the target through the peep sight 16, the arrow may be shot at the target and will fly to the distance at which the target is located. The dichroic filter glass only permits the reflected red dot of the LED's to be viewed at the archer's side of the sight so that it will not be seen at the field or target side of the sight.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A sighting device for mounting on an archery bow for aiding an archer to fire an arrow toward a target at a distance from the bow, said device comprising a housing for mounting on the bow, electrical circuit means including an electrical circuit board carried by said housing, said electrical circuit means comprising a source of electrical energy, a plurality of light emitting elements mounted on said circuit board in an aligned array, a tilt sensor connected in said circuit means carried by said housing and having a substantially linear electrical output responsive to angular inclinations of said bow, electrically programmable memory, means for storing in said memory a pre-selected range of values representative of angular inclinations of the bow in a vertical plane extending from said bow toward said target, means for permitting a selective portion of said range of values to be assigned to correspond to each light emitting element selectively and for storing into said memory the selective portion of said range for each corresponding light emitting element, and means responsive to the output of said tilt sensor for comparing the angular inclination of the bow with the portions of the range in said memory to determine the portion of the range corresponding to the angular inclination of the bow and for lighting the light emitting element corresponding thereto.

2. A sighting device as recited in claim 1, wherein said electrical circuit includes a plurality of switches, said means for permitting a selective portion of said range to be assigned to each light emitting element comprising means responsive to positions of said switches for selecting one light emitting element at a time to be chosen to correspond to a selective portion of said range.

3. A sighting device as recited in claim 2, wherein there are three switches, a first switch electrically activating and de-activating said sighting device, a second switch having three positions, one of said positions acting to energize and light one of said light emitting elements when said sighting device is electrically activated without regard to the angular disposition of said bow, and a third switch for selecting which light emitting element is chosen to be energized to light when said second switch is in said one of said positions.

4. A sighting device as recited in claim 3, including means for permitting a portion of said range of values to be assigned to a light emitting element chosen to be energized to light when said second switch is in a second position and for permitting said third switch to selectively change the portion of the range of values assigned to the light emitting element chosen when the second switch is in said second position and for permitting the selected portion of the range of values assigned to the chosen light emitting element to be held for storage in said memory, and means for storing in said memory said selected portion of said range of values held for storage when said second switch is in a third position.

5. A sighting device as recited in claim 1, wherein said housing includes upper and lower spaced apart walls, a slot formed in said upper wall, said circuit board being disposed on said upper wall with said array of light emitting elements overlaying said slot, a dichroic filter sight glass having a planar surface disposed intermediate said upper and lower walls below said slot at an angular inclination permitting the archer to view a target through said surface when sighting therethrough, said glass permitting all but one distinct color of visible light to pass therethrough when disposed at said inclination and to reflect said one distinct color on said surface, and said light emitting elements when lighted emitting light of said one distinct color such that a lighted light emitting element may be reflected on said surface and viewed by said archer.

6. A sighting device as recited in claim 5, wherein said electrical circuit includes a plurality of switches, said means for permitting a selective portion of said range to be assigned to each light emitting element comprising means responsive to positions of said switches for selecting one light emitting element at a time to be chosen to correspond to a selective portion of said range.

7. A sighting device as recited in claim 6, wherein there are three switches, a first switch electrically activating and de-activating said sighting device, a second switch having three positions, one of said positions acting to energize and light one of said light emitting elements when said sighting device is electrically activated without regard to the angular disposition of said bow, and a third switch for selecting which light emitting element is chosen to be energized to light when said second switch is in said one of said positions.

8. A sighting device as recited in claim 7, including means for permitting a portion of said range of values to be assigned to a light emitting element chosen to be energized to light when said second switch is in a second position and for permitting said third switch to selectively change the portion of the range of values assigned to the light emitting element chosen when the second switch is in said second position and for permitting the selected portion of the range of values assigned to the chosen light emitting element to be held for storage in said memory, and means for storing in said memory said selected portion of said range of values held for storage when said second switch is in a third position.

9. A sighting device as recited in claim 1, including first and second additional light emitting elements mounted on said circuit board spaced laterally from said array, said array being intermediate said first and second additional elements, means for storing in said memory a selected value representative of an angular disposition of the bow in a tilted plane inclined relative to said vertical plane corresponding to each of said first and second additional elements, and means responsive to the output of said tilt sensor for comparing the angular inclination of the bow in said tilted plane with each of said preselected values to determine if the angular inclination of the bow is equal to either of said preselected values and for lighting the respective first and second additional elements in response thereto.

10. A sighting device as recited in claim 9, wherein said housing includes upper and lower spaced apart walls, a slot formed in said upper wall, first and second apertures formed in said upper wall spaced from said slot, said circuit board being disposed on said upper wall with said array of light emitting elements overlaying said slot and with said first and second additional light emitting elements overlaying a respective one of said first and second apertures, a dichroic filter sight glass having a planar surface disposed intermediate said upper and lower wall below said slot and said apertures at an angular inclination permitting the archer to view a target through said surface when sighting therethrough, said glass permitting all but one distinct color of visible light to pass therethrough when disposed at said inclination and to reflect said one distinct color on said surface, and said light emitting elements when lighted emitting light of said one distinct color such that a light emitting element may be reflected on said surface and viewed by said archer.

11. A sighting device as recited in claim 9, wherein each preselected value is permanently stored in said memory.

12. A sighting device as recited in claim 9, wherein each preselected value may be selectively stored in said memory.

13. A sighting device as recited in claim 10, wherein each preselected value is permanently stored in said memory.

14. A sighting device as recited in claim 10, wherein each preselected value may be selectively stored in said memory.

15. A method of accurately firing an arrow from an archery bow toward a target at a distance from the bow, said method comprising providing a sighting device having an electrical circuit including a plurality of aligned light emitting elements, selecting one of said light emitting elements to light when said arrow is fired a first distance from said bow, storing in an electrically programmable memory corresponding to said one of said light emitting elements a value equal to the angular disposition of said bow in a vertical plane providing said first distance, repeating said selecting and said storing for each of the other light emitting elements in seriatim to store in said memory respective angular disposition values corresponding to respective distances, viewing the target through a sight glass on which a reflection of said light emitting elements may be seen when any of said light emitting elements are lighted, and thereafter aiming at said target and firing said arrow when one of said light emitting elements is seen on said glass in superposed relationship on said target.

* * * * *